United States Patent [19]

Meyer et al.

[11] Patent Number: 4,919,885

[45] Date of Patent: Apr. 24, 1990

[54] CORROSION RESISTANT STEEL STRUCTURAL MEMBER

[75] Inventors: Lutz Meyer, Voerde; Ludwig Hachtel, Wesel-Büderich; Günter Robusch, Essen, all of Fed. Rep. of Germany

[73] Assignee: Thyssen Stahl AG, Duisburg, Fed. Rep. of Germany

[21] Appl. No.: 252,006

[22] Filed: Sep. 28, 1988

Related U.S. Application Data

[63] Continuation of Ser. No. 81,505, Aug. 4, 1987, abandoned.

[30] Foreign Application Priority Data

Aug. 14, 1986 [DE] Fed. Rep. of Germany ..... 3627668

[51] Int. Cl.[5] ..... C22C 38/14

[52] U.S. Cl. ..... 420/104; 420/112; 420/126; 148/333

[58] Field of Search ..... 148/333; 420/104, 112, 420/126

[56] References Cited

FOREIGN PATENT DOCUMENTS 2320185 10/1974 Fed. Rep. of Germany .
2819227 11/1979 Fed. Rep. of Germany .
60-17055 1/1983 Japan ..... 420/104
60-24352 2/1985 Japan ..... 420/104
1495732 12/1974 United Kingdom .

OTHER PUBLICATIONS

"The Effects of Alloying Additions to Ferritic Steels upon Stress Corrosion Cracking Resistance"; R. N. Parkins, P. Q., Slattery and B. S. Poulson; National Association of Corrosion Engineers, vol. 37, No. 11, Nov. 1981.

*Primary Examiner*—Deborah Yee
*Attorney, Agent, or Firm*—Sprung Horn Kramer & Woods

[57] ABSTRACT

The invention relates to a structural steel having high resistance to intergranular stress operation cracking, more particularly in nitrate solutions and good welding properties (in % by mass):

0.01 to 0.04% carbon
up to 0.012% nitrogen
0.08 to 0.22% titanium with Ti equal or greater than 3.5 (C+N)
0.2 to 2.5% manganese
2.0 to 5.5% chromium
0.01 to 0.10% aluminium
up to 0.5% silicon
up to 1.0% nickel
up to 0.02% phosphorus
up to 0.02% sulphur
the residue being iron and unavoidable impurities.

6 Claims, 3 Drawing Sheets

F 947/66

STEEL A

F 488/61

STEEL B

F 492/7

STEEL C

F 488/71

STEEL $E_1$

F 492/1

STEEL $E_2$
NORMALIZED

H 533/18

STEEL $E_2$
QUENCHED
AND
TEMPERED

100 : 1

F 976 / 54

NORMALIZED STRUCTURE

100 : 1

F 545/39

QUENCHED AND TEMPERED STRUCTURE

100 : 1

H 724 /24

CORROSION RESISTANT STEEL STRUCTURAL MEMBER

This application is a continuation of application Ser. No 081,505, filed 8/14/87, now abandoned.

The invention relates to a structural steel having high resistance to intergranular stress corrosion cracking, more particularly in nitrate solutions and good welding properties.

BACKGROUND OF THE INVENTION

In high performance hot blast stoves which are operated at very high temperatures, damage occurs due to intergranular stress corrosion cracking. The damage is caused by the increased formation of nitrogen oxides in the hot blast, heated to temperatures of over 1 300° C., and by the occurrence of a nitrate-containing electrolyte when the blast moisture condenses on those structural plant components of the hot blast stoves which are conventionally made from unalloyed or low-alloy steels.

A measure for guarding against stress corrosion cracking which has already been successfully used for two decades s0 is to apply an outer thermal insulation (external insulation) by means of which the sheet metal temperature can be raised high enough to prevent the separation of the condensate which causes stress corrosion cracking.

High-alloy steels, such as stainless CrNiMo steels have also been successfully used., for example, for the particularly endangered heavily stressed compensators in the pipe systems of hot blast stoves or as a cladding material for sheet metal.

However, it is very expensive to equip a hot blast stoves with external insulation and to use stainless steels, so that an attempt is still being made to discover a steel alloy which is sufficiently resistant to stress corrosion cracking at a justifiable alloying expense.

German Patent 29 07 152 discloses a steel for the lining of furnaces, boilers and high temperature heaters in which nitrogen oxygen-containing combustion gases occur. The steel contains additions of chromium, molybdenum and niobium: (carbon +nitrogen) ratio must not be higher than 7. While the alloying elements chromium and molybdenum are important for the formation of a passive layer on the surface of the steel, niobium is intended to fix a proportion of the carbon and nitrogen, to prevent chromium impoverishment at the grain boundaries during welding or heating. The sum of carbon and nitrogen shall not be above 0.06%. With regard to the stoichiometric ratio, there is a deficiency of niobium as against carbon and nitrogen, so that inevitably chromium carbides and carbonitrides must also be formed. Titanium is mentioned as a further carbide and nitride-forming element., but it is not supposed to be as effective as niobium.

German Patent 28 19 227 discloses a manganese steel to be used in the normalized condition as a material for structural members which are exposed to alkaline, neutral or weakly acid solutions, more particularly for hot blast stoves. The steel contains a relatively high carbon content up to 0.18% and adjusted contents of phosphorus and sulphur in addition to manganese, niobium and copper, to prevent intergranular hydrogen-induced cracks. The steel can also optionally contain nickel, chromium and titanium. For the welding of the steel a complicated method is disclosed for achieving a higher resistance in welded constructions to stress corrosion cracking and other crack formation.

Resistance in nitrate or alkali media is defined in German Standard DIN 50915, but this Standard no longer corresponds to the present state of art. It has been found that steels shown to be resistant by this standard test were in fact not resistant under severe attack. Severe corrosion testing is performed in synthetic hot blast condensates or corresponding nitrate solutions at a constant critical strain rate of $10^{-6}$ to $10^{-7}$/sec. It therefore might be that a steel as disclosed in German Patent 28 19 227 does not fit when expoxed to practical conditions in a hot blast stove.

In the German Journal "Werkstoffe und Korrosion" (="Materials and Corrosion"), 20 (1969), No.4, pages 305 to 313 under the title "The present state of knowledge concerning the stress corrosion cracking of unalloyed and low-alloy steels" is disclosed that an increasing carbon content has very favourable effect on resistance to stress corrosion cracking, while steels having carbon contents of around or below 0.2% are supposed to be particularly sensitive. An improving effect is ascribed to titanium, in addition to other elements. The material given as an example, a soft iron containing 0.46% titanium, however, is so remote from actual steels and so problematic due to the very high titanium content as regards production, properties and costs, that it cannot be regarded as a starting point for a technical solution to the problem.

The statement that the stable fixation of carbon and nitrogen enhances resistance to stress corrosion cracking relates to the attack of solutions of alkalies, while nitrate solutions occur in hot blast stoves.

The Journal "Corrosion", (1981)., pages 650 to 664 publishes an assessment of the Literature and a comprehensive systematic investigation of the effect of chemical composition on the stress corrosion cracking of unalloyed and low-alloyed steels. One general conclusion drawn by the Paper is that chromium and titanium enhance resistance to stress corrosion cracking, the result concerning the effect of titanium deserving special attention, since the Literature and the experimental results which the Paper presents lead to the conclusion that any significant effect on resistance to stress corrosion cracking can be detected only with very high alloying contents of about 1% titanium. It is true that as regards the effect of the carbon content the Publication draws attention to the favourable corrosion behaviour of soft iron having a very low carbon content and 0.46 % titanium, but the basic message of this Publication, which agrees with other Literature, is the favourable effect of increasing carbon content on resistance to stress corrosion cracking. This is clearly expressed in the regression equation, in which resistance to stress corrosion cracking in nitrate solutions is demonstrated with increasing contents not only of titanium and chromium, but also of carbon. A similar effect is also ascribed to the nitrogen content. However, the emerging idea of making a steel more resistant to stress corrosion cracking by as high contents of titanium, carbon and nitrogen as possible comes up against considerable practical and economic problems.

The manufacturing difficulties and very heavy costs of such a steel are unjustifiable Surprisingly, the invention now shows that very satisfactory resistance to stress corrosion cracking can be achieved by limiting the carbon and nitrogen content to the lowest possible level and adapting thereto a titanium content of the order of magnitude of 0.1 to 0.2 %.

It is an object of the invention to provide a structural steel which can be welded by a very simple process and which has high resistance to stress corrosion cracking, more particularly in nitrate solutions, at a low expense of alloying elements and also has satisfactory toughness and ductility.

SUMMARY OF THE INVENTION

This object is achieved by a structural steel having high resistance to intergranular stress corrosion and excellent welding properties and the following composition (in % by mass):

0.01 to 0.04% carbon
up to 0.012% nitrogen
0.08 to 0.22% titanium with Ti equal or greater than 3,5. (C+N)
0.2 to 2.5% manganese
2.0 to 5.5% chromium
0.01 to 0.10% aluminium
up to 0.5% silicon
up to 1.0% nickel
up to 0.02% phosphorus
up to 0.02% sulphur
reside iron and unavoidable impurities.

A preferred composition (in % by mass) is:

0.01 to 0.02% carbon
up to 0.005% nitrogen
0.08 to 0.15% titanium with Ti equal or greater than 3.5. (C+N)
0.2 to 2.0% manganese
2.5 to 5.5% chromium
0.01 to 0.10% aluminium
up to 0.5% silicon
up to 0.01% phosphorus
up to 0.01% sulphur
residue iron and unavoidable impurities.

BRIEF DESCRIPTION OF THE DRAWINGS

FIG. 3 depicts three micrographs showing the surface area of steel samples tested for intergranular stress corrosion cracking. FIG. 3*b* depicts a normalized structure and FIG. 3*a* depicts a quenched and tempered structure.

DETAILED DESCRIPTION OF THE INVENTION

Figure 1:
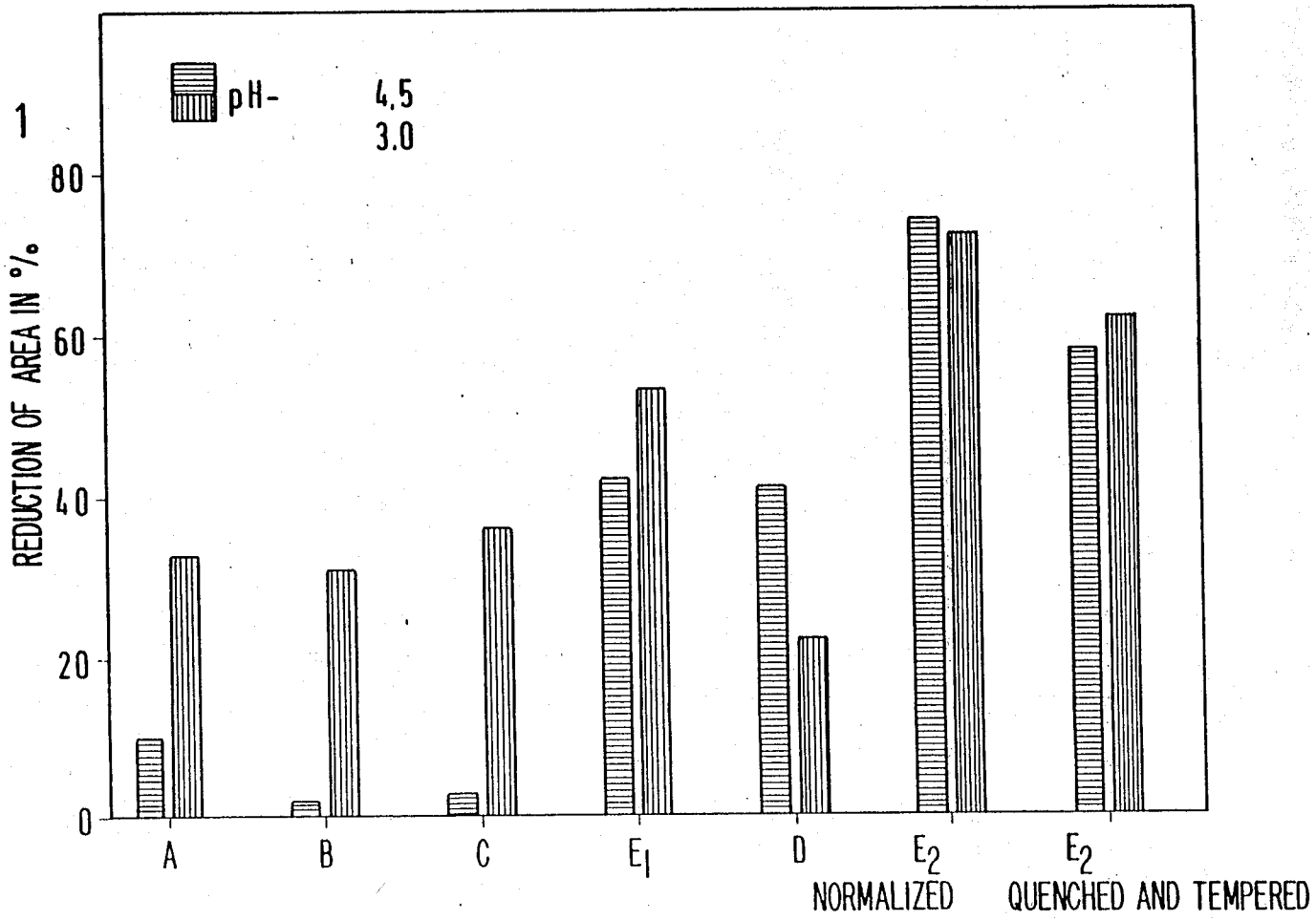
FIG. 1 is a bar graph depicting resistance to stress corrosion cracking, expressed as reduction of area upon rupture, for several steels.
Figure 2A:
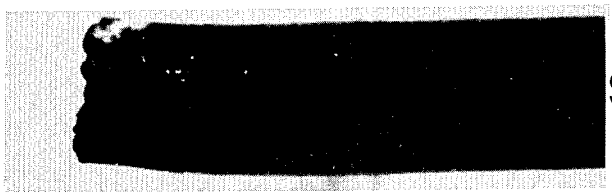
FIG. 2 depicts the microscopic appearance of steel specimens tested for stress corrosion cracking.
Figure 2B:
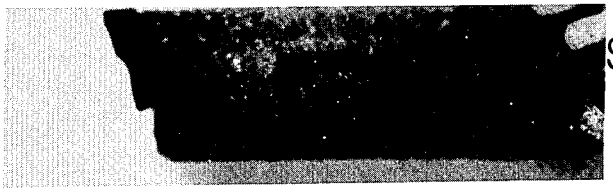
Figure 2C:
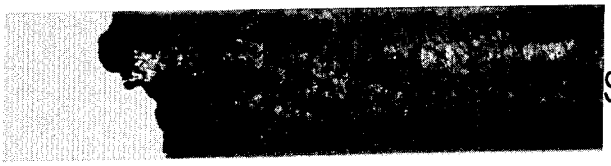
Figure 2D:
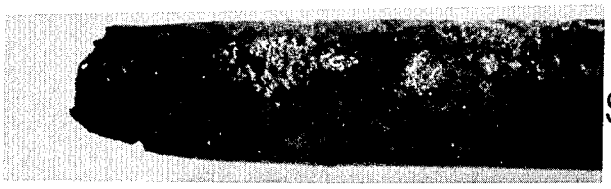
Figure 2E:
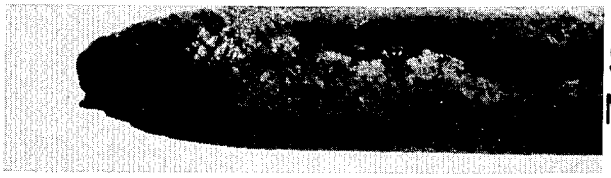
Figure 2F:
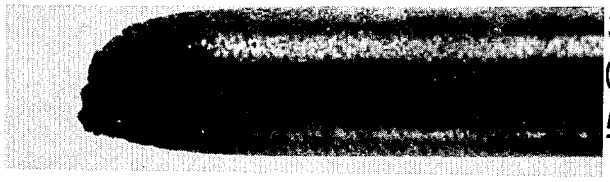

In the steel according to the invention, higher resistance to stress corrosion cracking can be achieved by the complete bonding of carbon and nitrogen by the strong carbonitride former titanium, with a superstoichiometric concentration of the titanium. Although German Patent No. 29 07 152 does not recommend titanium, it has now been proved that the addition of titanium according to the invention is particularly effective by cooperating with the given chromium content of 2.0 to 5.5% to ensure high security against stress corrosion cracking, more particularly in the conditions characteristic of hot blast stoves. A chromium content of less than 2 % has been recognized to be only little effective. By increasing the chromium content to more than 5.5% the machinability of the steel is progressively reduced and the costs are rising.

In the compound titanium carbide each titanium atom and carbon atom are bonded to one another. For totally bonding of carbon by titanium, due to the atomic weight of 48 for titanium and 12 for carbon a stoichiometric mass ratio of 4:1 is required —i.e., for a particular carbon content at least four times the mass content of titanium is required. If, as in the steel according to the invention, carbon and nitrogen are jointly fixed by titanium, due to the higher atomic weight of nitrogen of 14 the result is a somewhat lower stoichiometrical ratio. To ensure the stable bonding of the interstitial atoms of carbon and nitrogen, therefore, the required titanium content must be at least 3.5 times greater than the sum of the carbon and nitrogen contents.

In the steel according to the invention not only the sum of carbon and nitrogen, but also the individual contents of these elements are low. One of the objectives of this is to enable the absolute level of the required titanium content to be limited.

There are indications that stress corrosion cracking is also encouraged by the phosphorus which is included in the steel as incidental impurity and which is known for its inclination to become segregated at grain boundaries. On the other hand, titanium is an alloying element which in adequate concentration with regard to the carbon and nitrogen contents can also bond the phosphorus in the steel or at least considerably limit its activity. According to the invention, therefore, a titanium content superstoichiometric in relation to the sum of carbon and nitrogen reduces or eliminates the harmful effect of the phosphorus. In order to eliminate the harmful effect of the phosphorus already by the original content, a content of not more than 0.02% is provided for according to the invention. A higher phosphorus content would result in a higher tendency to stress corrosion cracking.

Also the sulfur content is not more than 0.02%. A higher sulphur content reduces the machinability during welding processing or shaping and, moreover, may fix a part of the alloying element titanium in an undesired way. To enhance strength and toughness, the steel according to the invention contains 0.2 to 2.5% manganese. A less manganese content reduces the toughness and the surface condition of the sheet. A manganese content of more than 2.5 % makes the metallurgical manufacturing more difficult and increases the costs without resulting in a worth mentioning improvement of the features. For the same reason up to 1.0% nickel can be added. By a higher nickel content the toughness is not further improved but the costs of the steel are increasing considerably. Aluminium is contained within the limits stated, in dependence on manufacture. The silicon content is limited to 0.5%. A higher silicon content may affect the welding behaviour and may reduce the security against brittle fracture.

The manufacture, processing and use of the steel according to the invention produce inter alia the following advantages:

in comparison with similar steels, for example, the steel preferred according to German Patent No. 29 07 152, the costs for alloying elements are substantially lower, even in the normalized condition, the steel according to the invention has outstanding resistance to stress corrosion cracking and therefore requires no relatively expensive hardening and tempering treatment, the toughness and ductility of the steel according to the invention are similar to the properties of conventional structural steels, such as those of St 52, in welding processing the steel according to the invention shows considerable advantages in comparison with similar conventional high-tensile structural steels. For example, in comparison with the steels of German Patent No. 28 19 227, neither preheating, nor a particular weld structure, nor a thermal postreatment are required, the course of hardness in the heat-affected zone is flat, security against cold cracks is very satisfactory, the welded connection is highly deformable.

The economic advantage of using the steel according to the invention for the manufacturers and operators of hot blast stoves or similar units becomes particularly clear, since it renders superfluous the hitherto necessary steps taken against the occurrence of stress corrosion cracking, such as external insulation of hot blast stoves or the use of relatively expensive austenitic stainless steels.

However, the steel according to the invention is also suitable for the structural members of heat exchangers, and also of furnaces, boilers, tanks, vessels and pipes exposed more particularly to nitrate solutions.

EXAMPLES

The invention will now be explained in more detail with reference to embodiments.

Table 1 shows the chemical composition of the steels investigated. Comparison steel A is a known unalloyed steel, while the comparison steels B and C are known alloyed steels having differing contents of chromium and/or titanium. Steel D falls within the range of German Patent No. 29 07 152. Steels E1 and E2 have compositions according to the invention. Table 2 shows the tensile strength, yield point and elongation upon rupture of the steels investigated and the behaviour of the steels as regards stress corrosion cracking when tested at a constant strain rate by the details of reduction of area upon rupture and when tested under constant load by details of service life up to rupture. The lower part of Table 2 indicates in details the conditions of the two stress corrosion cracking tests with constant strain rate and constant load. For the known steel D and the steels E1 and E2 according to the invention the quenched and tempered state was investigated as well as the normalized state, to allow a comparison in both states of heat treatment.

The values determined show the improved resistance to stress corrosion cracking of the steels E1 and E2 according to the invention. When assessing resistance towards intergranular stress corrosion cracking it must be remembered that after constant strain, reductions of area upon rupture represents a substantially more stringent criterion than service life after constant loading. Differentiation in favour of the steel according to the invention therefore becomes substantially even clearer in the case of the first-mentioned test criterion. The literature frequently discusses only the less stringent test conditions under constant loading.

FIG. 1 reproduces the results of testing for resistance to stress corrosion cracking, expressed in the reduction of area upon rupture of all the steels investigated.
Electrolyte composition: 10 g/l $NO_3^-$;
Temperature: 95° C.;
Strain rate: $1.8 \times 10^{-7}$/sec;
pH value: 4.5 or 3.0.

The diagram shows the improvement in resistance to stress corrosion cracking of the steels E1 and E2 according to the invention.

FIG. 2 shows the appearance of specimens tested for stress corrosion cracking. The degree of reduction of area upon rupture as a yardstick for resistance to stress corrosion cracking can clearly be seen. FIG. 2 depicts the microscopic appearance of the torn tensile specimen (Electrolyte with 10 g/l $NO_3^{-1}$, pH=4.5, 95° C., strain rate=$1.8.10^7$ $sec^1$).

The results of comprehensive series of tests, of which FIGS. 1 and 2 are representative, show that the steel according to the invention has a substantially better resistance to stress corrosion cracking than the other steels. A comparison between steels B und C, which are not according to the invention, indicates that a low addition of chromium or titanium in itself produces no improvement in resistance to stress corrosion cracking. The results for steel E1 according to the invention show that a combined addition of a low chromium content and an addition of titanium leads to higher resistance. The steel E2 according to the invention achieves a further improvement in resistance to stress corrosion cracking.

Figure 3A:
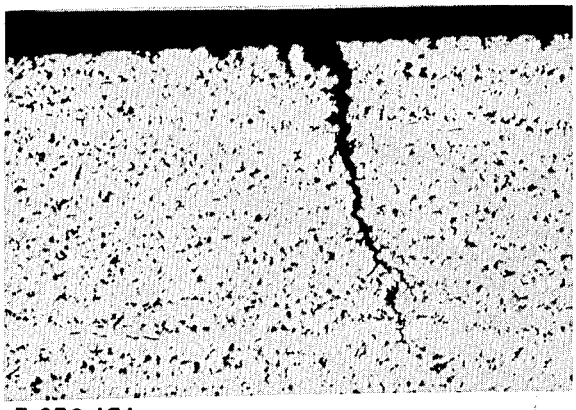
FIG. 3*a* depicts a comparison steel A.
Figure 3B:
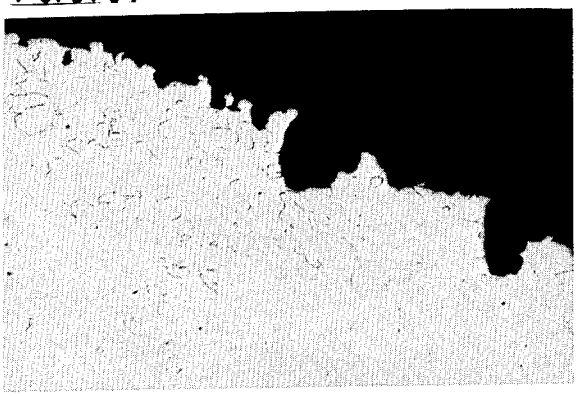
Figure 3C:
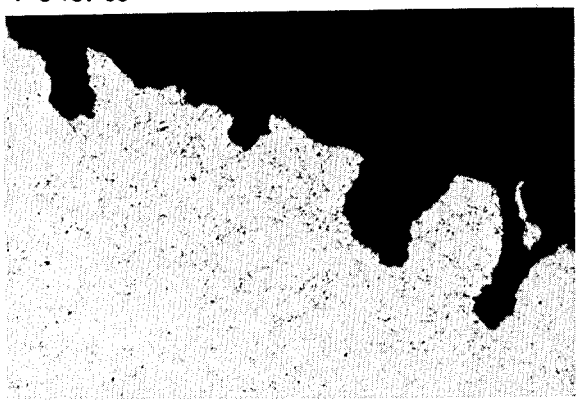

FIG. 3 comprises micrographs of the surface area of samples tested for intergranular stress corrosion cracking. The difference in the mechanism of structural change by the corrosive medium in conjunction with mechanical tensile stress can be seen. FIG. 3*a* shows an incipient crack occurring in the comparison steel A under the test conditions. In contrast, FIGS. 3*b* and 3*c* clearly indicates that the steel E2 according to the invention in the normalized and quenched and tempered condition does not show the usual distortion by stress corrosion cracking.

TABLE 1

Chemical composition of the steels (in % by mass)

| Steel | C | N | Si | Mn | P | S | Al | Cr | Ti | Ti / C + N |
|---|---|---|---|---|---|---|---|---|---|---|
| A | 0.10 | 0.005 | 0.22 | 0.62 | 0.018 | 0.012 | 0.032 | 0.03 | — | — |
| B | 0.021 | 0.003 | 0.25 | 1.0 | 0.009 | 0.008 | 0.020 | 2.54 | — | — |
| C | 0.024 | 0.006 | 0.24 | 1.18 | 0.009 | 0.008 | 0.025 | 0.02 | 0.15 | 5.0 |
| E1* | 0.024 | 0.003 | 0.24 | 1.0 | 0.009 | 0.008 | 0.020 | 2.57 | 0.14 | 5.2 |
| D | 0.025 | 0.003 | 0.24 | 0.70 | 0.009 | 0.008 | 0.029 | 6.07 | Mo: 0.52 Nb: 0.073 | |
| E2* | 0.026 | 0.003 | 0.25 | 1.0 | 0.009 | 0.008 | 0.022 | 5.01 | 0.14 | 4.8 |

*steel according to the invention

TABLE 2

Mechanical properties and stress corrosion cracking behavior of steels reduction of area TABLE 2-continued

| Steel | thermal treatment | tensile strength $R_m$ in N/mm² | yield point $R_{p0.2}$ in N/mm² | elongation reduction of area $A_5$ in % | elongation reduction of area Z in % | by stress corrosion cracking* in % pH = 3.0 | by stress corrosion cracking* in % pH = 4.5 | service life by stress corrosion cracking test in h pH = 4.5 |
|---|---|---|---|---|---|---|---|---|
| A | normalized | 430 | 302 | 30 | 60 | 33 | 10 | 120 |
| B | normalized | 365 | 227 | 42 | 88 | 31 | 2 | 210 |
| C | normalized | 320 | 166 | 41 | 90 | 36 | 3 | >2100 |
| D | normalized | 799 | 609 | 15 | 64 | 22 | 39 | |
| | quenched and tempered | 570 | 481 | 24 | 79 | 21 | 31 | >1500 |
| E1 | normalized | 382 | 196 | 40 | 90 | 53 | 42 | >2800 |
| | quenched and tempered | 437 | 330 | 29 | 80 | 58 | 40 | |
| E2 | normalized | 448 | 256 | 38 | 78 | 72 | 74 | >2800 |
| | quenched and tempered | 476 | 377 | 27 | 88 | 62 | 58 | |

*Conditions of the stress corrosion cracking tests:

| | electrolyte composition | temperature | strain rate | load |
|---|---|---|---|---|
| constant strain rate | 10 g $NO_3^-$/l | 95° C. | $1.8 \cdot 10^{-7}\ s^{-1}$ | — |
| constant loading | 100 g $NO_3^-$/l | boiling | — | $1.4 \cdot R_{p0.2}$ |

We claim:

1. In a structural member of hot blast stoves, heat exchangers, furnaces, boilers, tanks, vessels and pipes exposed to intergranular stress corrosion cracking in nitrate-containing solutions, constructed of a weldable structural steel, wherein the improvement comprises that the structural steel having high resistance to intergranular stress corrosion cracking in nitrate-containing solutions and good weldability, consists essentially in % by mass, of 0.01 to 0.04 % carbon
up to 0.012 % nitrogen
0.08 to 0.22 % titanium with Ti equal or greater than 3.5 (carbon + nitrogen)
0.2 to 2.5 % manganese
2.0 to 5.5 % chromium
0.01 to 0.10 % aluminium
up to 0.5 % silicon
up to b 1.0 % nickel
up to 0.02 % phosphorus
up to 0.02 % sulphur,
the residue being iron and unavoidable impurities.

2. A structural member according to claim 1, wherein the structural steel consists essentially, in % by mass, of 0.01 to 0.02 % carbon
up to 0.005 % nitrogen
0.08 to 0.15 % titanium with Ti equal or greater than 3.5 (carbon + nitrogen)
0.2 to 2.0 % manganese
2.5 to 5.5 % chromium
0.01 to 0.1 % aluminium
up to 0.5 % silicon
up to 0.01 % phosphorus
up to 0.01 % sulphur,
the residues being iron and unavoidable impurities.

3. A structural member according to claim 1, constructed of a weldable structural steel having the composition set forth in claim 1, which has good resistance to intergranular stress corrosion cracking in nitrate-containing solutions and good weldability, even without thermal pretreatment and postreatment.

4. A structural member according to claim 2, constructed of a weldable structural steel having the composition set forth in claim 8, which has good resistance to intergranular stress corrosion cracking in nitrate-containing solutions and good weldability, even without thermal pretreatment and postreatment.

5. A structural member according to claim 1, constructed of a weldable structural steel having the composition set forth in claim 7 which, with simultaneous and corrosive stressing, has a service life of more than 2,400 hours under a stress corrosion cracking test in a boiling solution containing 100 g nitrate per liter under a constant load of 1.4 $R_{p\ 0.2}$, and a reduction of area upon rupture of more than 40% after a stress corrosion cracking test in a solution at 95° C. containing 10 g nitrate per liter with a constant strain rate.

6. A structural member according to claim 3, constructed of a weldable structural steel having the composition set forth in claim 8 which, with simultaneous and corrosive stressing, has a service life of more than 2,400 hours under a stress corrosion cracking test in a boiling solution containing 100 g nitrate per liter under a constant load of 1.4 $R_{p\ 0.2}$, and a reduction of area upon rupture of more than 40% after a stress corrosion cracking test in a solution at 95° C. containing 10 g nitrate per liter with a constant strain rate.

* * * * *

UNITED STATES PATENT AND TRADEMARK OFFICE

CERTIFICATE OF CORRECTION

PATENT NO. : 4,919,885

DATED : April 24, 1990

INVENTOR(S) : Lutz Meyer, et al

It is certified that error appears in the above-identified patent and that said Letters Patent is hereby corrected as shown below:

| | |
|---|---|
| Title Page, Abstract, line 2 | Delete "operation" and substitute --corrosion-- |
| Col. 7, line 37 | Before "1.0 % nickel" delete "b" |
| Col. 8, line 27 | Delete "claim 8" and substitute --claim 2-- |
| Col. 8, line 34 | Delete "claim 7" and substitute --claim 1-- |
| Col. 8, line 42 | Delete "claim 3" and substitute --claim 2-- |
| Col. 8, lihe 44 | Delete "claim 8" and substitute --claim 2-- |

Signed and Sealed this

Nineteenth Day of May, 1992

*Attest:*

*Attesting Officer*

DOUGLAS B. COMER

*Acting Commissioner of Patents and Trademarks*